US010871064B2

(12) United States Patent
Gray

(10) Patent No.: US 10,871,064 B2
(45) Date of Patent: Dec. 22, 2020

(54) DETERMINING DOWNHOLE FORCES USING PRESSURE DIFFERENTIALS

(71) Applicant: Halliburton Energy Services, Inc., Houston, TX (US)

(72) Inventor: Steven Kyle Gray, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 240 days.

(21) Appl. No.: 15/736,120

(22) PCT Filed: Sep. 2, 2015

(86) PCT No.: PCT/US2015/048103
§ 371 (c)(1),
(2) Date: Dec. 13, 2017

(87) PCT Pub. No.: WO2017/039650
PCT Pub. Date: Mar. 9, 2017

(65) Prior Publication Data

US 2018/0179883 A1 Jun. 28, 2018

(51) Int. Cl.
*E21B 47/06* (2012.01)
*E21B 41/00* (2006.01)
(Continued)

(52) U.S. Cl.
CPC ..... *E21B 47/06* (2013.01); *E21B 33/12* (2013.01); *E21B 41/00* (2013.01); *E21B 47/024* (2013.01); *E21B 47/07* (2020.05); *E21B 47/12* (2013.01)

(58) Field of Classification Search
CPC ..... E21B 47/06; E21B 47/0006
See application file for complete search history.

(56) References Cited

U.S. PATENT DOCUMENTS 5,386,724 A 2/1995 Das et al.
5,878,817 A * 3/1999 Stastka ..... E21B 43/121 166/372

(Continued)

FOREIGN PATENT DOCUMENTS

WO 2006071591 7/2006
WO 2008112331 9/2008
WO 2014184586 11/2014

OTHER PUBLICATIONS

International Patent Application No. PCT/US2015/048103, "International Search Report and Written Opinion", dated May 12, 2016, 8 pages.

*Primary Examiner* — Giovanna Wright
(74) *Attorney, Agent, or Firm* — Kilpatrick Townsend & Stockton LLP

(57) ABSTRACT

A system can include an upper completion string including an outer mandrel and an inner mandrel positioned coaxially within the outer mandrel. The upper completion string can include a first pressure sensor in communication with a first chamber via a first channel extending through an outer housing of the outer mandrel for detecting a first pressure within the first chamber and transmitting an associated sensor signal. The first chamber can have a boundary that is defined at least in part by (i) an outer surface of the inner mandrel, (ii) an inner surface of the outer mandrel, and (iii) at least two protrusions positioned between the outer surface of the inner mandrel and the inner surface of the outer mandrel. The system can include a computing device in communication with the first pressure sensor for determining a pressure difference between the first pressure and another pressure.

20 Claims, 9 Drawing Sheets

(51) Int. Cl.

| | |
|---|---|
| ***E21B 33/12*** | (2006.01) |
| *E21B 47/07* | (2012.01) |
| *E21B 47/024* | (2006.01) |
| *E21B 47/12* | (2012.01) |

(56) References Cited

U.S. PATENT DOCUMENTS

| | | | | |
|---|---|---|---|---|
| 7,878,266 | B2 | 2/2011 | Griffin et al. | |
| 8,733,438 | B2 | 5/2014 | Kenison et al. | |
| 8,939,039 | B2 | 1/2015 | Ratcliffe et al. | |
| 2004/0129424 | A1* | 7/2004 | Hosie | E21B 21/08 166/332.8 |
| 2005/0103123 | A1 | 5/2005 | Newman | |
| 2006/0070734 | A1 | 4/2006 | Zillinger et al. | |
| 2009/0071645 | A1* | 3/2009 | Kenison | E21B 44/00 166/250.01 |
| 2009/0078462 | A1* | 3/2009 | Boone | E21B 7/068 175/26 |
| 2010/0217575 | A1 | 8/2010 | Briers et al. | |
| 2012/0111633 | A1 | 5/2012 | Kumar et al. | |
| 2013/0213129 | A1 | 8/2013 | Kumar et al. | |
| 2013/0306374 | A1 | 11/2013 | Wood | |
| 2014/0013837 | A1 | 1/2014 | Lee et al. | |
| 2014/0284058 | A1 | 9/2014 | Watson et al. | |
| 2015/0021093 | A1* | 1/2015 | Clark | E21B 47/0006 175/40 |
| 2015/0059463 | A1 | 3/2015 | Kenison et al. | |
| 2015/0226622 | A1 | 8/2015 | Cheng et al. | |

* cited by examiner

DETERMINING DOWNHOLE FORCES USING PRESSURE DIFFERENTIALS

TECHNICAL FIELD

The present disclosure relates generally to devices for use with well systems. More specifically, but not by way of limitation, this disclosure relates to a system for determining downhole forces using pressure differentials.

BACKGROUND

An extended-reach well can be drilled from a subterranean formation for extracting hydrocarbons (e.g., oil or gas) from the subterranean formation. In an extended reach well, the hydrocarbons can be positioned in the subterranean formation at a large distance from a surface of the extended-reach well. For example, the hydrocarbons can be positioned 5 miles (8.05 km) or more from the surface of the extended-reach well. The large distance between the surface of the extended-reach well and the hydrocarbons can present a variety of challenges.

DETAILED DESCRIPTION

Figure 1:
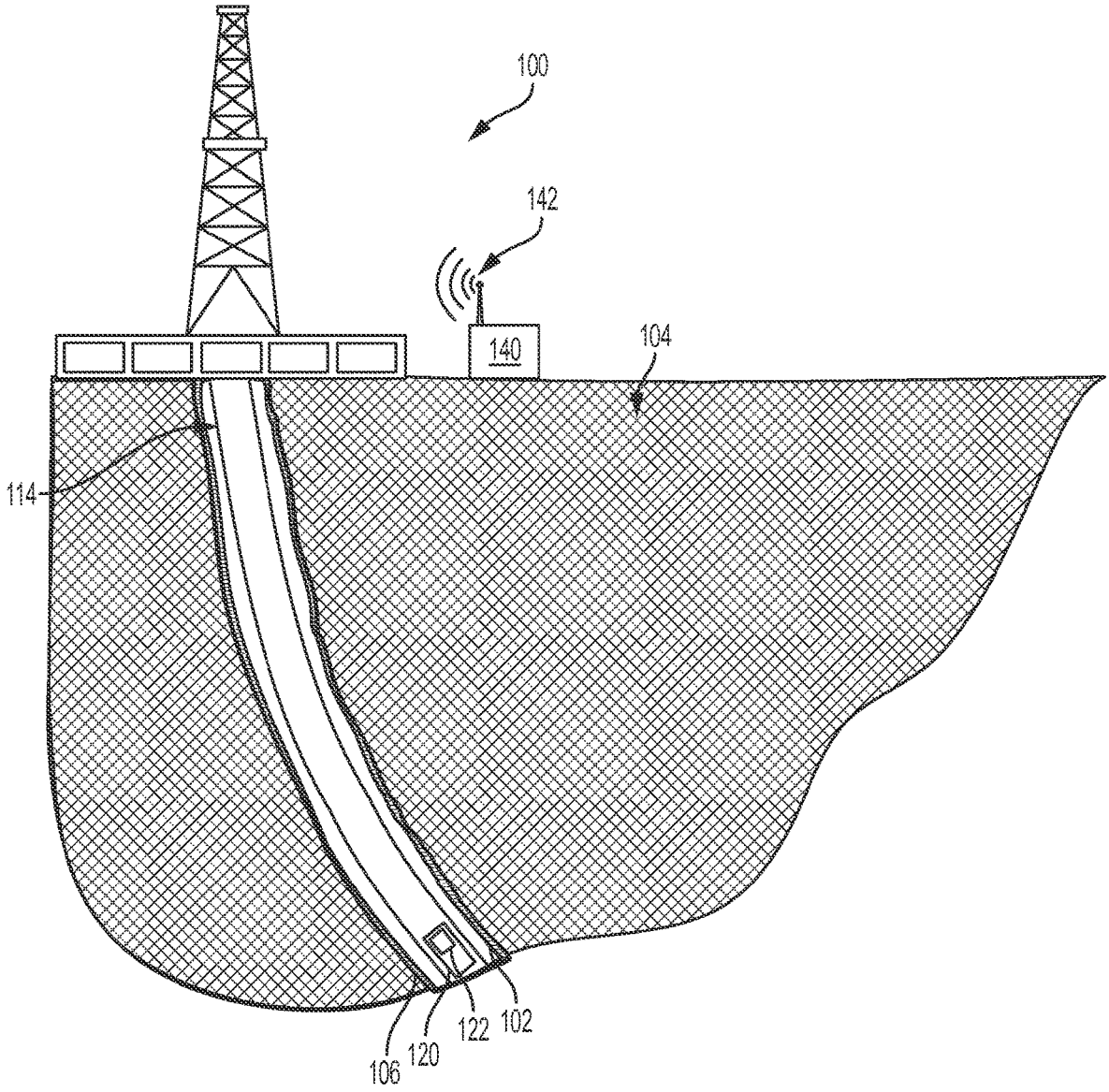
FIG. 1 is a cross-sectional view of an example of a hydrocarbon extraction well system for accessing and removing hydrocarbons from a subterranean formation according to some aspects.

Certain aspects and features of the present disclosure relate to a system for determining downhole forces using pressure differentials. The system can include a pressure-sensing device coupled externally to an outer housing of a well tool (e.g., an upper completion string). The pressure-sensing device can include multiple pressure sensors coupled externally to the outer housing of the well tool. The pressure sensors can detect pressures within different chambers internal to the well tool via channels between the pressure sensors and the chambers. The pressure-sensing device can transmit pressure data from the pressure sensors to a computing device. The computing device can receive the pressure data and determine a pressure difference between at least two pressures detected by the pressure sensors. In some examples, the computing device can determine whether the well tool contacted another well component (e.g., a lower completion string), whether the well tool coupled with the other well component, a force with which the well tool contacted the other well component, or any combination of these based on the pressure difference. The computing device can notify a well operator if the well tool contacts, or couples with, the other well component.

In some examples, the boundaries of the different chambers internal to the well tool can be defined at least in part by an outer mandrel of the well tool and an inner mandrel of the well tool. For example, an upper boundary of a chambers can be defined by an inner surface of the outer mandrel. A lower boundary of the chambers can be defined by an outer surface of the inner mandrel. In some examples, one or more protrusions extending radially outward from the outer surface of the inner mandrel can define one or more lateral boundaries of the chambers. For example, the lateral ends of the chambers can be defined by protrusions positioned between the outer surface of the inner mandrel and the inner surface of the outer housing of the well tool.

In some examples, the pressure-sensing device can include one or more sealing devices for generating pressure seals around the chambers. For example, a sealing device can be positioned coaxially around the outer surface of the inner mandrel and adjacent to a lateral end of a chamber for generating a pressure seal, at least in part, between the chamber and an external well environment. Another sealing device can be positioned coaxially around the outer surface of the inner mandrel and adjacent to another lateral end of the chamber for generating a pressure seal, at least in part, between the chamber and the external well environment, between the chamber and an adjacent chamber, or both. The sealing devices can enhance the accuracy of the pressures detected by the pressure sensors.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a cross-sectional view of an example of a hydrocarbon extraction well system 100 for accessing and removing hydrocarbons (e.g., oil or gas) from a subterranean formation 104. The hydrocarbon extraction well system 100 includes a wellbore 102 drilled from the subterranean formation 104. The wellbore 102 can include a casing 106. The casing 106 can include multiple connected tubes of the same length or different lengths, or the same diameter or different diameters, positioned in the wellbore 102. A cement sheath can be positioned between the casing 106 and a wall of the wellbore.

The hydrocarbon extraction well system 100 can also include other well components, such as a well tool 114. In some examples, the well tool 114 can include an upper completion string that can be coupled with a lower completion string positioned in the wellbore 102. In other examples, the well tool 114 can include a mud motor, a bottom hole assembly, or a reamer.

In some examples, the well tool 114 can include a pressure-sensing device 120 for determining downhole forces using pressure differentials. The pressure-sensing device 120 can include one or more pressure sensors coupled to the well tool 114 for detecting one or more pressures (e.g., as discussed in greater detail with respect to FIGS. 3-6). An example of the pressure sensor can include a ROC™ downhole pressure gauge by Halliburton™. The pressure-sensing device 120 can detect one or more pressures and transmit sensor signals associated with the one or more pressures to a computing device 140 (discussed in greater detail below). In some examples, the pressure-sensing device 120 can transmit the sensor signals to the computing device 140 via a communication device 122 internal to, or otherwise coupled to, the pressure-sensing device 120. The communication device 122 can be configured substantially the same as the communication device 142 described in greater detail below.

The hydrocarbon extraction well system 100 can include a computing device 140 for receiving one or more sensor signals from the pressure-sensing device 120. The computing device 140 can be positioned at the wellbore surface, below ground, within a well tool (e.g., well tool 114), or offsite. The computing device 140 can include a processor interfaced with other hardware via a bus. A memory, which can include any suitable tangible (and non-transitory) computer-readable medium, such as RAM, ROM, EEPROM, or the like, can embody program components that configure operation of the computing device 140. The computing device 140 can include input/output interface components (e.g., a display, keyboard, touch-sensitive surface, and mouse) and additional storage. In some examples, the computing device 140 can be configured substantially similarly to the computing device 402 of FIG. 4.

The computing device 140 can transmit data to and receive data from the pressure-sensing device 120 via a communication device 142. The communication device 142 can represent one or more of any components that facilitate a network connection. In the example shown in FIG. 1, the communication device 142 is wireless and can include wireless interfaces such as IEEE 802.11, Bluetooth, or radio interfaces for accessing cellular telephone networks (e.g., transceiver/antenna for accessing a CDMA, GSM, UMTS, or other mobile communications network). In other examples, the communication device 142 can be wired and can include interfaces such as Ethernet, USB, IEEE 1394, or a fiber optic interface. In some examples, the communication device 142 can include another interface for another communication protocol, such as a proprietary communication protocol.

In some examples, it can be desirable for the well operator to prevent the well tool 114 from coupling with or contacting another well tool (not shown) in the wellbore 102. In other examples, it can be desirable for the well operator to cause the well tool 114 to couple with the other well tool in the wellbore 102. For example, the well operator may wish to couple an upper completion string (e.g., well tool 114) to a lower completion string positioned in the wellbore 102 to generate a continuous conduit through which hydrocarbons can be extracted from the wellbore 102. It can be challenging for the well operator to determine if the well tools have contacted one another, coupled with one another, and with how much force the well tools contacted one another. For example, the hydrocarbon extraction well system 100 can include an extended-reach well system. The extended-reach well system can include a large distance between the surface of the wellbore 102 and a well tool, such as a lower completion string. The large distance can make it challenging for the well operator to determine if the upper completion string has contacted or coupled with the lower completion string. In some examples, the pressure-sensing device 120 can provide the well operator with data usable to determine when the well tools have contacted one another, whether the well tools have coupled with one another, with how much force the well tools contacted one another, or any combination of these.

For example, the pressure-sensing device 120 can include at least two pressure sensors. The pressure-sensing device 120 can transmit pressure data from each of the pressure sensors to the computing device 140. The computing device 140 can receive the pressure data and determine a pressure difference between at least two of the pressures provided by the pressure sensors. For example, the computing device 140 can determine the pressure difference by subtracting a pressure provided by one pressure sensor from another pressure provided by another pressure sensor. Based on the pressure difference, the computing device 140 can determine whether the well tools have contacted one another, whether the well tools have coupled with one another, with how much force the well tools contacted one another, or any combination of these. The computing device 140 can determine that the well tools contacted one another in response to determining the pressure differential exceeds a threshold. In some examples, the threshold can include 500 pounds per square inch (psi).

In some examples, the computing device 140 can receive a detected pressure from a pressure sensor of the pressure-sensing device 120. Based on the detected pressure, the computing device 140 can determine whether the well tools have contacted one another, whether the well tools have coupled with one another, with how much force the well tools contacted one another, or any combination of these. For example, the computing device 140 can determine that two well tools contacted one another in response to determining that the detected pressure exceeds a threshold. In some examples, the computing device 140 can determine a trend indicated by multiple pressures detected by the pressure-sensing device 120 over a time period. Based on the trend, the computing device 140 can determine whether the well tools have contacted one another, whether the well tools have coupled with one another, with how much force the well tools contacted one another, or any combination of these. For example, the computing device 140 can determine that two well tools contacted one another if the trend indicates a rapid increase in pressure or a rapid decrease in pressure occurred during the time period.

In some examples, the computing device 140 can provide the well operator with information associated with whether the well tools have contacted one another, whether the well tools have coupled with one another, with how much force the well tools contacted one another, or any combination of these. For example, the computing device 140 can notify the well operator that the well tools contacted one another, and/or with how much force the well tools contacted one another, in response to a determined force exceeding a threshold.

Figure 2:
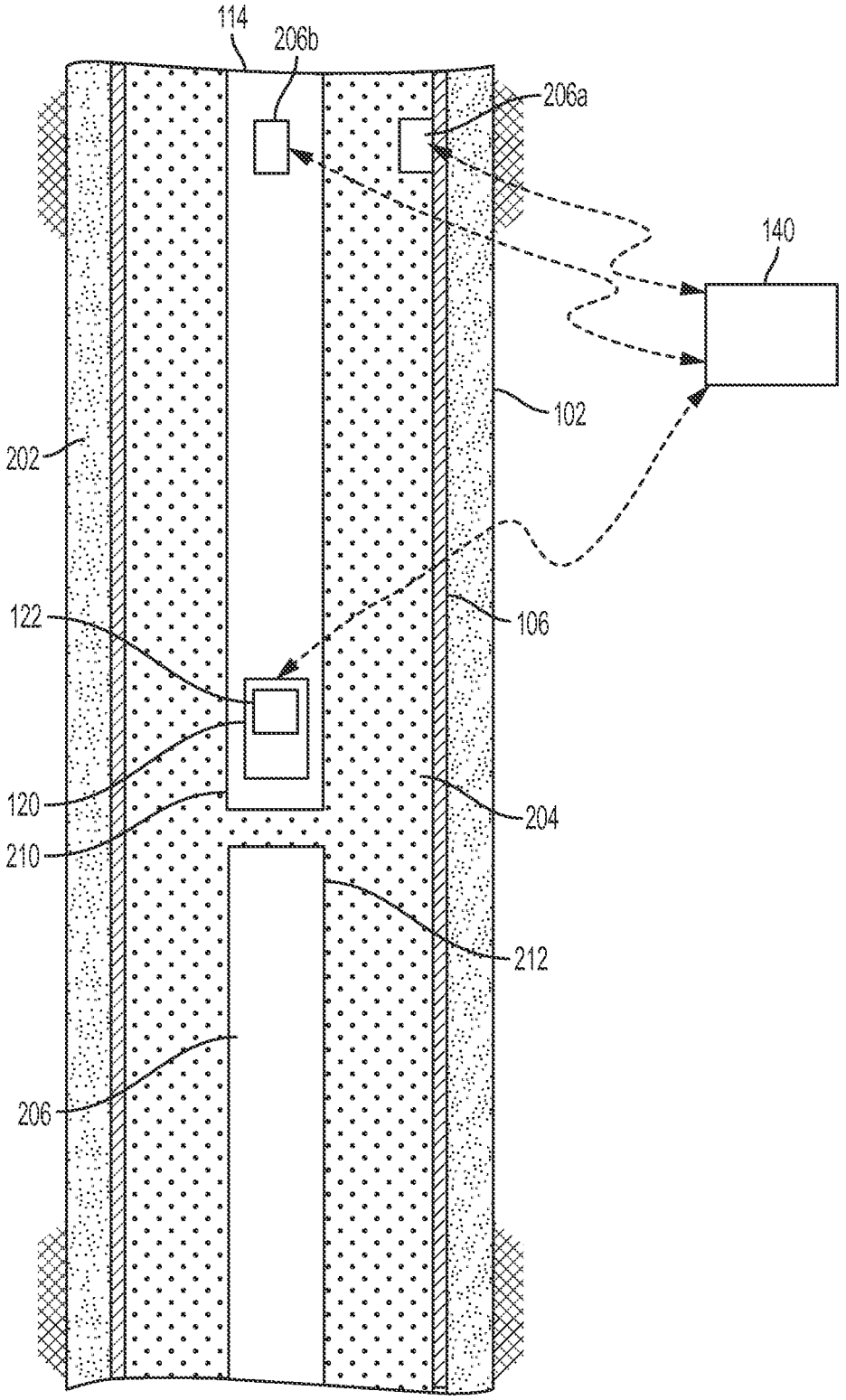
FIG. 2 is a cross-sectional view of an example of a part of the hydrocarbon extraction well system of FIG. 1 according to some aspects.

FIG. 2 is a cross-sectional view of an example of a part of the hydrocarbon extraction well system of FIG. 1 according to some aspects. The hydrocarbon extraction well system includes a wellbore 102. The wellbore 102 can include a casing 106 and a cement sheath 202. In some examples, the wellbore 102 can include a fluid 204, such as a liquid or a gas. The fluid 204 (e.g., mud) can flow in an annulus positioned between one or more well tools 114, 206 and a wall of the casing 106.

The well tool 114 (e.g., an upper completion string) can be positioned in the wellbore. The well tool 114 can include a pressure-sensing device 120. In some examples, the pressure-sensing device 120 can be in communication with another electronic device (e.g., computing device 140) via communication device 122. The communication device 122 can be internal to or external to the well tool 114.

In some examples, the well system can include additional sensors 206*a-b*. For example, the well system can include another sensor 206*a* coupled to the well tool 114. Examples of the additional sensors 206*a-b* can include pressure sensors, temperature sensors, inclinometers, fluid flow sensors, gyroscopes, accelerometers, or any combination of these. In some examples, the additional sensors 206*a-b* can be in communication with another electronic device via a communication device (e.g., configured substantially similarly to communication device 122). For example, sensor 206*b* can be coupled to another electronic device via a wired interface. In some examples, the sensors 206*a-b* can be coupled to, or included within, pressure-sensing device 120.

In some examples, another well tool 206 (e.g., a lower completion string) can be positioned in the wellbore. It can be desirable for the well operator to cause the well tool 114 to contact or couple with the other well tool 206 in the wellbore 102. For example, one longitudinal end 210 of one well tool 114 can be coupleable with another longitudinal end 212 of another well tool 206. The well operator may wish to couple the longitudinal ends 210, 212 together to create a continuous channel through which one or more fluids can flow. But it can be challenging for the well operator to determine if the longitudinal ends 210, 212 have contacted one another, when the longitudinal ends 210, 212 have coupled with one another, and with how much force the longitudinal ends 210, 212 contacted each other. In other examples, it can be desirable for the well operator to prevent the well tool 114 from coupling with or contacting the other well tool 206 in the wellbore 102. For example, the well operator may wish to prevent the well tool 114 from contacting the well tool 206 to avoid damaging the well tool 114. But it can be challenging for the well operator to determine if the well tool 114 has contacted the other well tool 206, with how much pressure the well tool 114 contacted the other well tool 206, or both.

In some examples, the computing device 140 can receive one or more sensor signals from the pressure-sensing device 120, sensor 206*a*, sensor 206*b*, or any combination of these. The computing device 140 can determine, based on the sensor signal(s), whether the well tools 114, 206 have contacted one another, whether the well tools 114, 206 have coupled with one another, with how much force the well tools 114, 206 contacted one another, or any combination of these.

For example, the computing device 140 can receive a sensor signal from the pressure-sensing device 120 indicating a first pressure. The computing device 140 can receive a sensor signal from sensor 206*a-b* indicating a second pressure. In some examples, the sensor 206*a-b* can be at a distance from the pressure-sensing device 120. The computing device 140 can calibrate the second pressure to account for the distance. For example, the computing device 140 can calibrate the second pressure using a fluid weight between the position of the sensor 206*a-b* in the wellbore 102 and the position of the pressure-sensing device 120 in the wellbore. The computing device 140 can determine the fluid weight by multiplying a weight of a fluid 204 in the wellbore (e.g., 9 pounds/gallon) by a distance between the sensor 206*a-b* and the pressure-sensing device 120. In some examples, the weight of the fluid 204, the distance between the sensor 206*a-b* and the pressure-sensing device 120, or both can be stored in a memory of the computing device 140 or otherwise predetermined. The computing device 140 can add the fluid weight to the second pressure to determine a calibrated pressure. In some examples, the computing device 140 can determine a pressure difference between the first pressure and the calibrated pressure. Based on the pressure difference, the computing device 140 can determine if the well tools 114, 206 have contacted one another, if the well tools 114, 206 coupled with one another, with how much force the well tools 114, 206 contacted one another, or any combination of these.

In some examples, the computing device 140 can receive a detected pressure from the pressure-sensing device 120, sensor 206*a*, or sensor 206*b*. Based on the detected pressure, the computing device 140 can determine whether the well tools have contacted one another, whether the well tools have coupled with one another, with how much force the well tools contacted one another, or any combination of these. For example, the computing device 140 can determine that two well tools contacted one another in response to determining that the detected pressure exceeds a threshold.

In some examples, the computing device 140 can determine a trend indicated by multiple detected pressures from the pressure-sensing device 120, sensor 206*a*, sensor 206*b*, or any combination of these. Based on the trend, the computing device 140 can determine if the well tools 114, 206 have contacted one another, if the well tools 114, 206 coupled with one another, with how much force the well tools 114, 206 contacted one another, or any combination of these. For example, the computing device 140 can receive multiple detected pressures over a time period from pressure sensor 206*b*. The computing device 140 can determine a trend based on the multiple detected pressures. The computing device 140 can determine that two well tools contacted one another if the trend indicates a rapid increase in pressure or a rapid decrease in pressure occurred during the time period.

Figure 3:
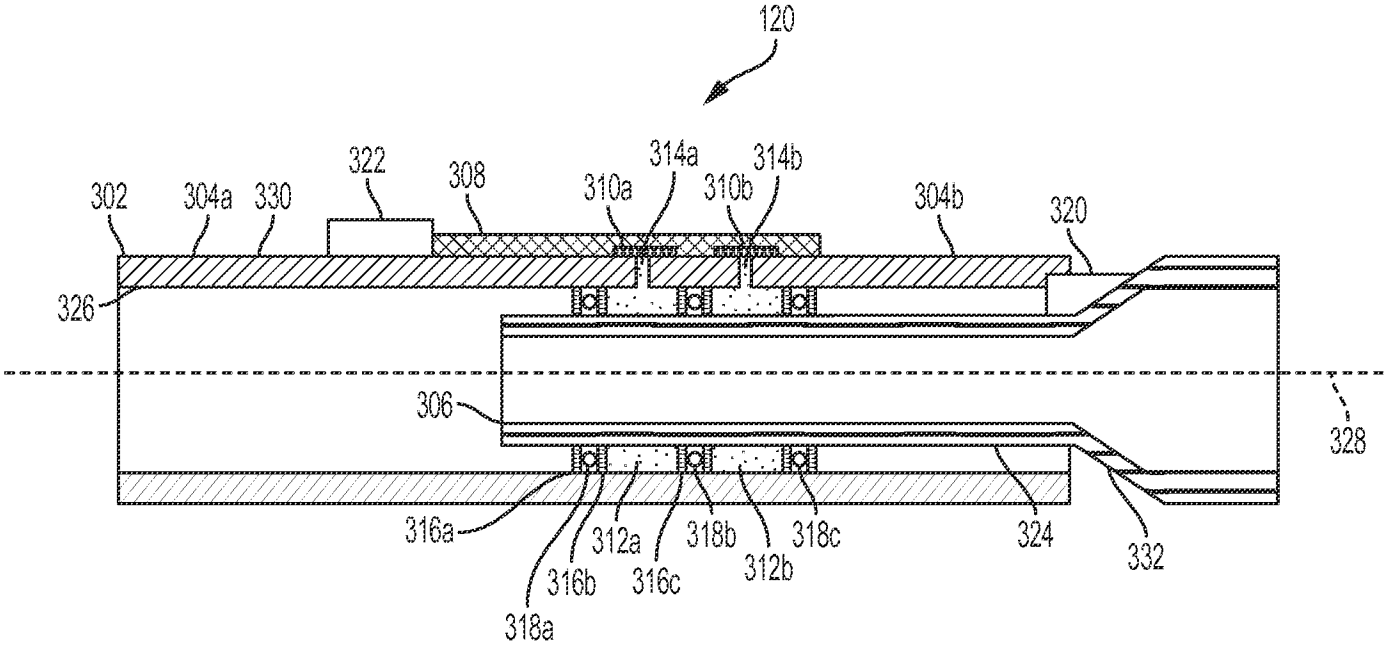
FIG. 3 is a cross-sectional view of an example of a pressure-sensing device for determining downhole forces using pressure differentials according to some aspects.
Figure 4:
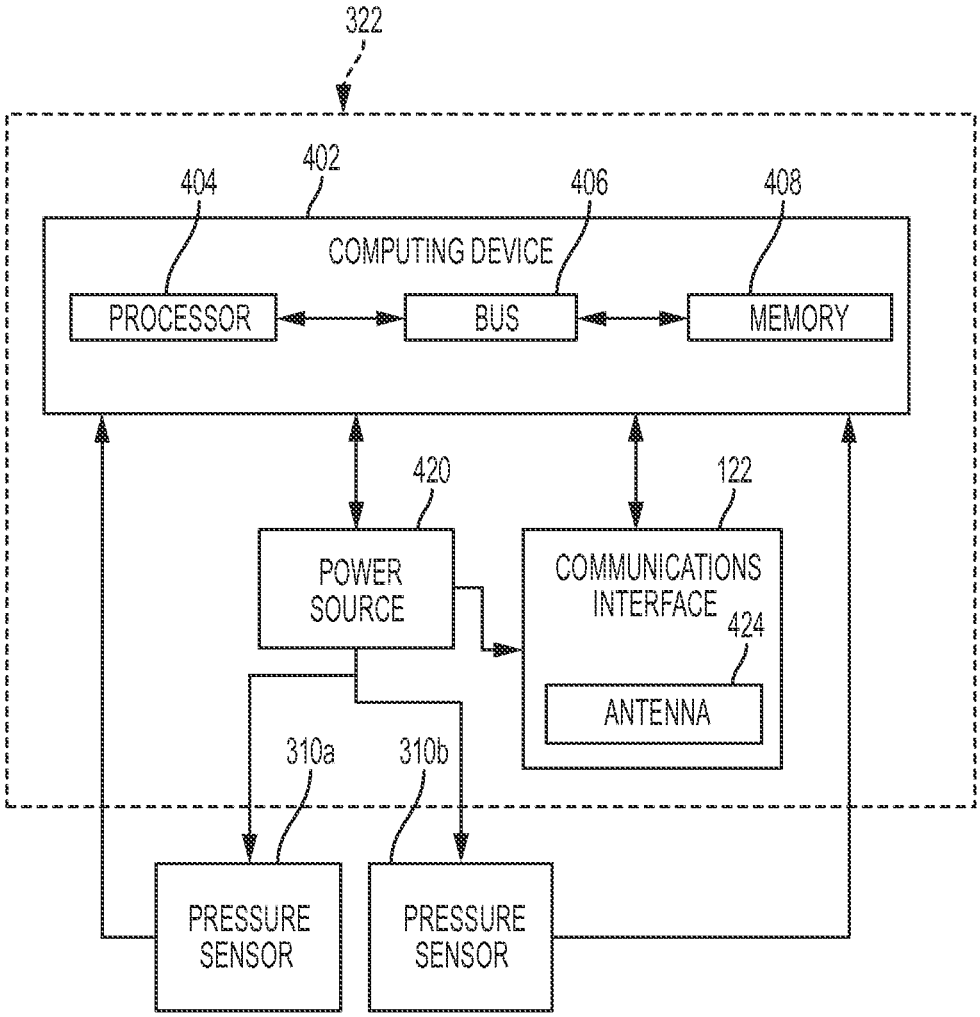
FIG. 4 is a block diagram of an example of a pressure-sensing device for determining downhole forces using pressure differentials according to some aspects.

FIG. 3 is a cross-sectional view of an example of a pressure-sensing device 120 for determining downhole forces using pressure differentials according to some aspects. In some examples, the pressure-sensing device 120 can include an outer mandrel 302. The outer mandrel 302 can include a substantially circular cross-sectional end shape. The outer mandrel 302 can be, or can be part of, a well tool, such as an upper completion string.

In some examples, the pressure-sensing device 120 can include an inner mandrel 306 positioned, at least in part, within (e.g., positioned coaxially within) the outer mandrel 302. A portion of the inner mandrel 306 positioned within the outer mandrel 302 can include a smaller cross-sectional end diameter than the cross-sectional end diameter of the outer mandrel 302. In some examples, at least a portion of the inner mandrel 306 can be positioned externally to the outer mandrel 302. For example, one lateral end of the inner mandrel 306 can be positioned within the outer mandrel 302 and include a cross-sectional end diameter that is smaller than the cross-sectional end diameter of the outer mandrel 302. Another lateral end of the inner mandrel 306 can be positioned externally to the outer mandrel 302 and include another cross-sectional end diameter that is substantially the same size as, or larger than, the cross-sectional end diameter of the outer mandrel 302. In some examples, at least a portion of the inner mandrel 306 can taper 332 from a larger diameter to a smaller diameter (or vice versa). In some examples, the inner mandrel 306 can act as a conduit through while one or more fluids can flow.

A pressure-sensing device 308 can be externally coupled to the outer mandrel 302. For example, the pressure-sensing device 308 can be coupled externally to an outer surface 330 of an outer housing of the outer mandrel 302. The pressure-sensing device 308 can include one or more pressure sensors 310*a-b*. For example, the pressure-sensing device 308 can include two pressure sensors 310*a-b*. In some examples, a channel 314*a-b* can be positioned between a pressure sensor 310*a-b* and a chamber 312*a-b*. For example, the channel 314*a* can be positioned between the pressure sensor 310*a* and the chamber 312*a*. The channel 314*b* can be positioned between the pressure sensor 310*b* and the chamber 312*b*. The channels 314*a-b* can allow each pressure sensor 310*a-b* to determine a respective pressure associated with a respective chamber 312*a-b*. In some examples, the chambers 312*a-b* can include one or more fluids.

The boundaries of the chambers 312*a-b* can be defined, in part, by an inner surface 326 of the outer mandrel 302 and an outer surface 324 of the inner mandrel 306. The boundaries of the chambers 312*a-b* can also be defined, in part, by one or more protrusions 316*a-b*. In some examples, the protrusions 316*a-b* can extend radially outward from the outer surface 324 of the inner mandrel 306 to the inner surface 326 of the outer mandrel 302. In other examples, the protrusions 316*a-b* can extend radially inward from the inner surface 326 of the outer mandrel 302 to the outer surface 324 of the inner mandrel 306. The protrusions 316*a-b* can be part of, or coupled to, the inner mandrel 306 or the outer mandrel 302. The protrusions 316*a-b* can include any suitable material, such as metal, rubber, or plastic. In some examples, a boundary of a chamber 312*a-b* can include at least two protrusions 316*a-b*. For example, a boundary of chamber 312*a* can include protrusion 316*b* and protrusion 316*c*. As another example, a left side of the boundary of the chamber 312*a* can include protrusion 316*a* and protrusion 316*b*.

In some examples, a boundary of a chamber 312*a-b* can include a sealing device 318*a-c*, such as an O-ring. The sealing device 318*a-c* can form at least a partial pressure seal around a chamber 312*a-b*. The sealing device 318*a-c* can traverse at least a portion of a circumference of the inner mandrel 306. For example, the sealing device 318*a-c* can traverse an entire circumference of the outer surface 324 of the inner mandrel 306. In some examples, the sealing device 318*a-c* can be positioned between two protrusions 316*a-b*. For example, a sealing device 318*a* can be positioned between protrusion 316*a* and protrusion 316*b*. The two protrusions 316*a-b* can keep the sealing device 318*a* in a desired position.

In some examples, the pressure-sensing device 120 can include multiple sealing devices 318*a-c*. The sealing devices 318*a-c* can prevent external pressures associated with the well environment, pressures associated with an adjacent chamber 312*a-b*, or both from impacting pressure measurements taken by the pressure sensors 310*a-b*. For example, the pressure-sensing device 120 can include a sealing device 318*a* forming at least a portion of a left-most boundary of chamber 312*a*, a sealing device 318*c* forming at least a portion of a right-most boundary of chamber 312*b*, and a sealing device 318*b* forming at least a portion of a common boundary between chamber 312*a* and chamber 312*b*.

In some examples, the pressure-sensing device 120 can include additional components 322. For example, referring to FIG. 4, the additional components 322 can include a computing device 402, a communication device 122, a power source 420, or any combination of these. In some examples, the components shown in FIG. 4 (e.g., the power source 420, communication device 122, processor 404, bus 406, and memory 408) can be integrated into a single structure. For example, the components can be within a single housing. In other examples, the components shown in FIG. 4 can be distributed (e.g., in separate housings) and in electrical communication with each other.

The additional components 322 can include a processor 404, a memory 408, and a bus 406. The processor 404 can execute one or more operations for operating the pressure-sensing device 120. The processor 404 can execute instructions stored in the memory 408 to perform the operations. The processor 404 can include one processing device or multiple processing devices. Non-limiting examples of the processor 404 include a Field-Programmable Gate Array ("FPGA"), an application-specific integrated circuit ("ASIC"), a microprocessor, etc.

The processor 404 can be communicatively coupled to the memory 408 via the bus 406. The non-volatile memory 408 may include any type of memory device that retains stored information when powered off. Non-limiting examples of the memory 408 include electrically erasable and programmable read-only memory ("EEPROM"), flash memory, or any other type of non-volatile memory. In some examples, at least some of the memory 408 can include a medium from which the processor 404 can read instructions. A computer-readable medium can include electronic, optical, magnetic, or other storage devices capable of providing the processor 404 with computer-readable instructions or other program code. Non-limiting examples of a computer-readable medium include (but are not limited to) magnetic disk(s), memory chip(s), ROM, random-access memory ("RAM"), an ASIC, a configured processor, optical storage, or any other medium from which the processor 404 can read instructions. The instructions can include processor-specific instructions generated by a compiler or an interpreter from code written in any suitable computer-programming language, including, for example, C, C++, C#, etc.

The additional components 322 can include a power source 420. In some examples, the power source 420 can include a battery or a thermal electric generator (e.g., for powering the pressure-sensing device 120). In other examples, the power source 420 can include an electrical cable (e.g., a wireline) electrically coupled to the additional components 322.

The additional components 322 can include a communication device 122. As discussed above, the communication device 122 can include a wired interface or a wireless interface (which can include an antenna 424). For example, the communication device 122 can include a wireline electrically coupled to the additional components 322. The wireline can additionally provide power to the pressure-sensing device 120. In some examples, part of the communication device 122 can be implemented in software. For example, the communication device 122 can include instructions stored in memory 408.

The pressure-sensing device 120 can use the communication device 122 to communicate with one or more external devices. In some examples, the communication device 122 can amplify, filter, demodulate, demultiplex, demodulate, frequency shift, and otherwise manipulate a signal received from an external device. The communication device 122 can transmit a signal associated with the received signal to the processor 404. The processor 404 can receive and analyze the signal to retrieve data associated with the received signal.

In some examples, the processor 404 can analyze the data from the communication device 122 and perform one or more functions. For example, the processor 404 can generate a response based on data. The processor 404 can cause a response signal associated with the response to be transmitted to the communication device 122. The communication device 122 can generate a transmission signal (e.g., via the antenna 424) to communicate the response to a remote electronic device. For example, the communication device 122 can amplify, filter, modulate, frequency shift, multiplex, and otherwise manipulate the response signal to generate the transmission signal. In some examples, the communication device 122 can encode data within the response signal using a modulation technique (e.g., frequency modulation, amplitude modulation, or phase modulation) to generate the transmission signal. In some examples, the communication device 122 can transmit the transmission signal to the antenna 424. The antenna 424 can receive the transmission signal and responsively generate a wireless communication. In this manner, the pressure-sensing device 120 can receive, analyze, and respond to communications from an external electronic device.

In some examples, the additional components 322 can include other hardware or software. Examples of hardware can include a transistor, resistor, capacitor, inductor, integrated circuit component, another memory device, another processor, an operational amplifier, a tube, a comparator, a timing device, or any combination of these.

Referring back to FIG. 3, in some examples, the outer housing of the outer mandrel 302 can include multiple sections 304*a-b*. For example, the outer housing can include a first section 304*a*. The pressure-sensing device 308 can be coupled, at least in part, to the first section 304*a*. In some examples, the outer housing can include a second section 304*b*. A gap can be formed between the first section 304*a* and the second section 304*b*. The pressure-sensing device 308 can be coupled, at least in part, to the second section 304*b*. In some examples, the second section 304*b* can be rotatable about a central axis 328 of the inner mandrel 306. For example, because the second section 304*b* can be disconnected from the first section 304*a* and the inner mandrel 306, the second section 304*b* may be able to rotate freely about the central axis 328.

It can be desirable, in some examples, to prevent the second section 304*b* from rotating freely about the central axis 328. For example, rotation of the second section 304*b* can prevent a portion of the well tool coupled to the first section 304*a* from rotating, or being rotated by, a portion of the well tool coupled to the inner mandrel 306. This can inhibit well operations. In some examples, an anti-rotation key 320 can be positioned for preventing the second section 304*b* from rotating about the central axis 328. For example, the anti-rotation key 320 can couple the second section 304*b* to the inner mandrel 306. This coupling can prevent the second section 304*b* from rotating independently of the inner mandrel 306.

In some examples, the pressure sensor 310*a* can detect an increased pressure and the pressure sensor 310*b* can detect a decreased pressure in response to a lateral tension being applied to the outer mandrel 302. For example, the pressure sensor 310*a* can detect an increased pressure and the pressure sensor 310*b* can detect a decreased pressure in response to the first section 304*a* and the second section 304*b* being pulled laterally apart. In some examples, the pressure sensor 310*a* can detect a decreased pressure and the pressure sensor 310*b* can detect an increased pressure in response to a laterally compressive force being applied to the outer mandrel 302. For example, the pressure sensor 310*a* can detect a decreased pressure and the pressure sensor 310*b* can detect an increased pressure in response to the first section 304*a* and the second section 304*b* being pushed laterally together. The pressure-sensing device 120 can transmit a pressure detected by the pressure sensor 310*a* and another pressure detected by the pressure sensor 310*b* to a computing device (e.g., the computing device 140 of FIG. 1).

In some examples, the computing device 140 can determine a difference between the detected pressures. The computing device 140 can determine that two well tools have contacted one another, or coupled with one another, in response to the difference exceeding a threshold. In some examples, the computing device 140 can analyze multiple pressure differences over a period of time to determine if the pressure differences are indicative of a particular well event, such as two well tools coupling together. For example, the computing device 140 can compare the multiple pressure differences to data (e.g., stored in memory) indicative of two well tools coupling together. The computing device 140 can determine that the two well tools coupled together in response to a trend or pattern indicated by the multiple pressure differences being substantially similar to a trend or pattern, respectively, indicated by the data. In some examples, the computing device 140 can notify a well operator, via a notification message, that the two well tools have contacted one another, coupled with one another, or both. In some examples, the computing device 140 can notify the well operator of an amount of force with which two well components contacted one another.

In some examples, the computing device 140 can determine that two well tools have contacted one another, or coupled with one another, in response to a pressure from a pressure sensor 310*a-b* exceeding a threshold. In other examples, the computing device 140 can generate a running average of multiple pressures detected by pressure sensor 310*b* (or pressure sensor 310*a*). The computing device 140 can compare the running average to a pressure detected by pressure sensor 310*a* (or pressure sensor 310*b*) to determine a difference. The computing device 140 can determine that two well tools have contacted one another, or coupled with one another based on the difference.

In some examples, a pressure sensor 310*a-b* can be usable up to a maximum amount of pressure. The maximum amount of pressure for which a pressure sensor 310*a-b* is usable can be referred to as the maximum psi rating. For example, the maximum psi rating for a pressure sensors 310*a-b* can be 30,000 psi. The maximum psi rating can be an upper pressure limit detectable by a pressure sensor 310*a-b*. If the maximum psi rating is surpassed, the pressure sensor 310*a-b* can break or output erroneous data. In some examples, the wellbore environment can apply a baseline amount of pressure to a pressure sensor 310*a-b* when the pressure sensor 310*a-b* is positioned in the wellbore. The baseline amount of pressure can be near the maximum psi rating for a pressure sensor 310*a-b*. For example, a wellbore environment can apply a bottom hole pressure 28,000 psi to the pressure sensors 310*a-b*. If the wellbore environment applies a baseline pressure to a pressure sensor 310*a-b* that is at or near the maximum psi rating for the pressure sensor 310*a-b*, the pressure sensor 310*a-b* may be unable to adequately detect increases in pressure (e.g., due to two well tools contacting one another or coupling to one another). For example, if the maximum psi rating for a pressure sensor

310*a-b* is 30,000 psi, and the wellbore environment applies 28,000 psi to the pressure sensor 310*a-b*, the pressure sensor 310*a-b* may only be able to detect up to a 2,000 psi increase in pressure. This may be insufficient to accurately detect with a desired amount of precision whether two well tools have contacted one another, coupled to one another, or both. In some examples, the pressure-sensing device 120 can include a higher rated pressure sensor 310*a-b* to mitigate such an issue. But a higher rated pressure sensor 310*a-b* may be unavailable or too costly. In other examples, the pressure-sensing device 120 can be configured to account for such pressure issues.

Figure 5:
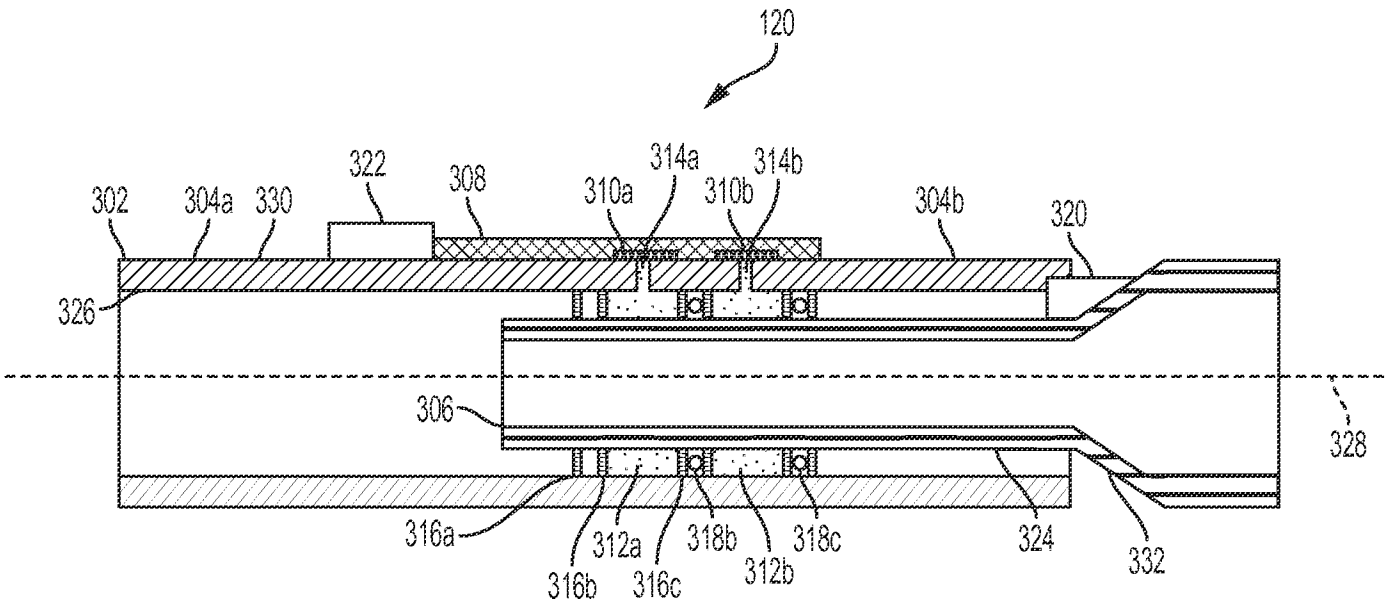
FIG. 5 is a cross-sectional view of another example of a pressure-sensing device including two sealing devices according to some aspects.

For example, referring to FIG. 5, a pressure-sensing device 120 can include two sealing devices 318*b-c* according to some aspects. In the example shown in FIG. 5, sealing device 318*a* of FIG. 3 has been removed. In some examples, pressure sensor 310*a* can detect a pressure applied to the pressure sensor 310*a* by a wellbore environment. The pressure detected by the pressure sensor 310*a* can remain substantially constant, regardless of the compression or tension applied to the outer mandrel 302. The pressure sensor 310*b* can detect a decreasing amount of pressure in response to a tension force being laterally applied to the outer mandrel 302. In some examples, the pressure-sensing device 120 can transmit the pressure applied by the wellbore environment and the pressure detected by the pressure sensor 310*b* to a computing device (e.g., computing device 140). The computing device 140 can determine a pressure difference between the pressures and use the pressure difference to determine whether two well tools have contacted one another, whether two well tools have coupled to one another, with how much force two well tools contacted one another, or any combination of these.

Figure 6:
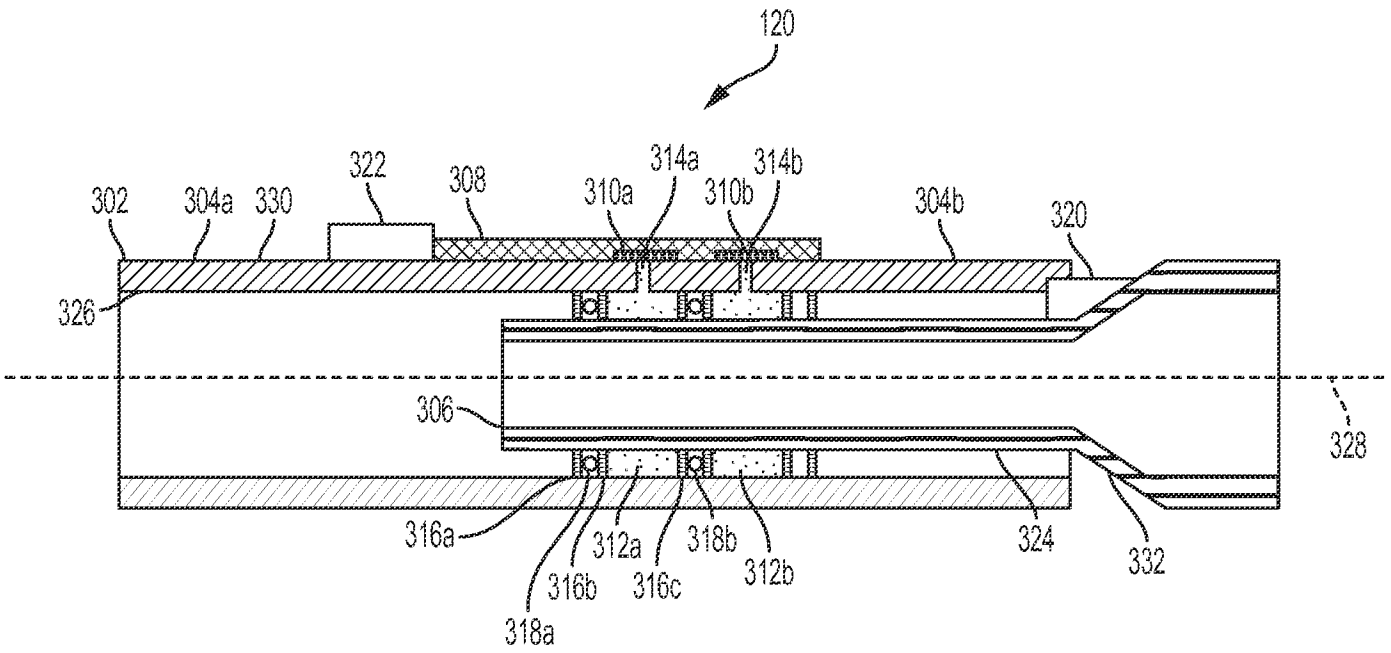
FIG. 6 is a cross-sectional view of another example of a pressure-sensing device including two sealing devices according to some aspects.

As another example, referring to FIG. 6, a pressure-sensing device 120 can include two sealing devices devices 318*a-b* according to some aspects. In the example shown in FIG. 6, sealing device 318*c* of FIG. 3 has been removed. In some examples, pressure sensor 310*b* can detect a pressure applied to the pressure sensor 310*a* by a wellbore environment. The pressure detected by the pressure sensor 310*b* can remain substantially constant, regardless of the compression or tension applied to the outer mandrel 302. The pressure sensor 310*a* can detect a decreasing amount of pressure in response to a compression force being laterally applied to the outer mandrel 302. In some examples, the pressure-sensing device 120 can transmit the pressure applied by the wellbore environment and the pressure detected by the pressure sensor 310*a* to a computing device (e.g., computing device 140). The computing device 140 can determine a pressure difference between the pressures and use the pressure difference to determine whether two well tools have contacted one another, whether two well tools have coupled to one another, with how much force two well tools contacted one another, or any combination of these.

Figure 7:
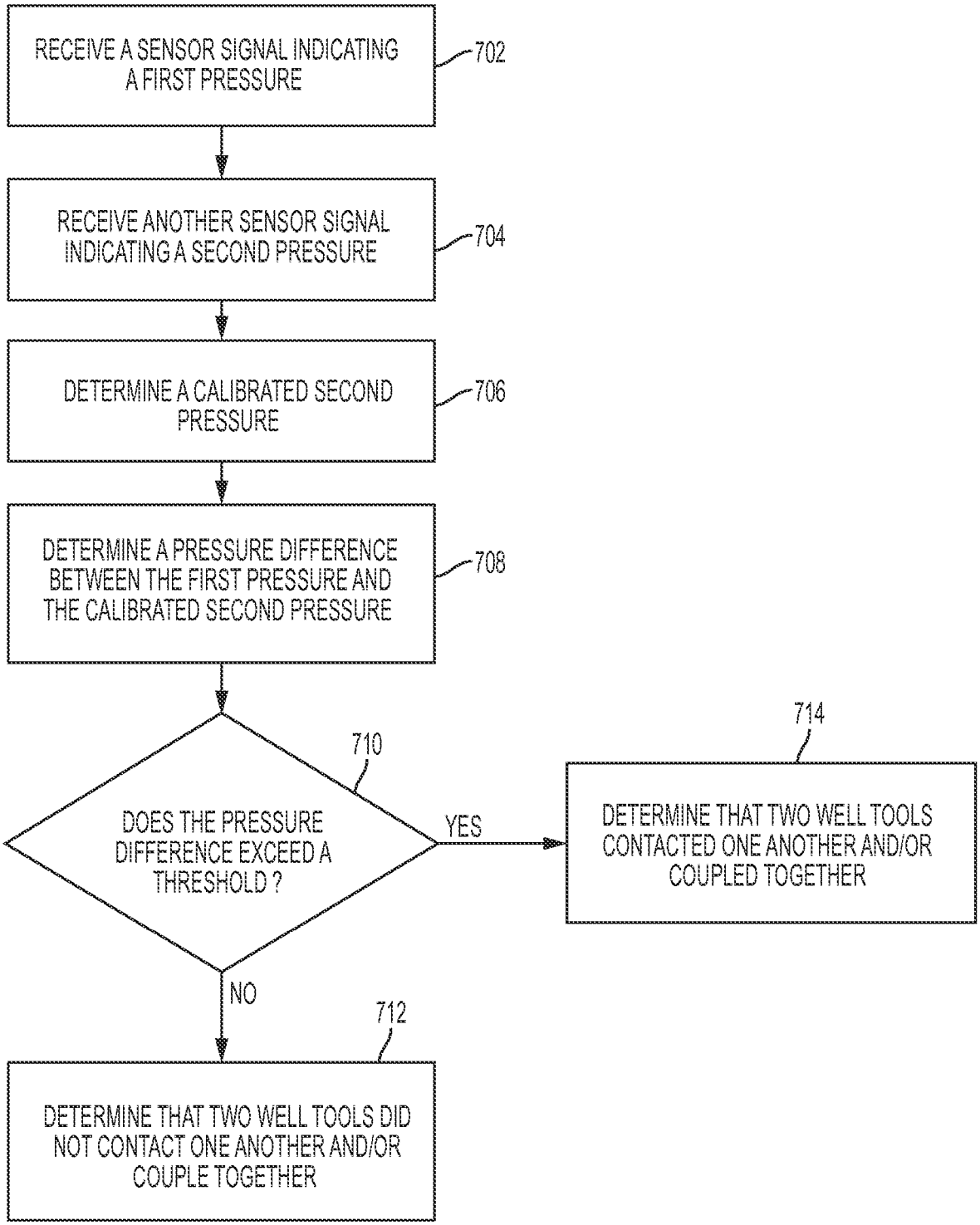
FIG. 7 is a flow chart of an example of a process for determining downhole forces using pressure differentials according to some aspects.

FIG. 7 is an example of a flow chart of a process for determining downhole forces using pressure differentials according to some aspects.

In block 702, a computing device (e.g., computing device 140 of FIG. 1) receives a sensor signal indicating a first pressure. The computing device can receive the sensor signal from a pressure-sensing device (e.g., pressure-sensing device 120 of FIG. 1) that includes one or more pressure sensors. The first pressure can represent a pressure applied to a pressure sensor by a wellbore environment or a pressure within a chamber of a well tool. The sensor signal can include an analog or a digital signal.

In block 704, the computing device receives another sensor signal indicating a second pressure. The computing device can receive the sensor signal from the pressure-sensing device or another sensor positioned within the wellbore (e.g., a sensor 206*a-b* of FIG. 2). The second pressure can represent a pressure applied to a pressure sensor by a wellbore environment or a pressure within a chamber of a well tool. The sensor signal can include an analog or a digital signal.

In block 706, the computing device determines a calibrated second pressure. In some examples, the computing device can determine the calibrated second pressure by adding or subtracting a calibration value to the second pressure. In some examples, the calibration value can be determined based on a weight of a fluid (e.g., fluid 214 of FIG. 2) in a wellbore, a distance between two pressure sensors, or both. For example, the computing device can determine the calibration value by multiplying a distance between two pressure sensors by a weight of a fluid positioned between the two pressure sensors in the wellbore. The computing device can add the calibration value to the second pressure, or subtract the calibration value from the second pressure, to determine the calibrated second pressure. In other examples, the computing device may not calibrate the second pressure and may use the second pressure as the calibrated second pressure.

In block 708, the computing device determines a pressure difference between the first pressure and the calibrated second pressure. In some examples, the computing device can determine a pressure difference between the first pressure and a calibrated second pressure. The computing device can determine the pressure difference by subtracting the first pressure from the calibrated second pressure, or by subtracting the calibrated second pressure from the first pressure.

In block 710, the computing device determines if the pressure difference exceeds a threshold. If so, the process can proceed to block 714. Otherwise, the process can proceed to block 712.

In block 714, the computing device can determine that two well tools contacted one another, coupled together, or both. The computing device can output a notification (e.g., via a display or speaker) indicating that two well tools contacted one another, coupled together, or both. In some examples, the computing device can additionally or alternatively output a notification indicating an amount of force with which the two well tools contacted one another.

In some examples, the computing device can transmit one or more signals (e.g., digital signals) associated with the two well tools contacting one another, coupling together, or both to another electronic device. In some examples, the electronic device can be configured to cause at least one well tool to move (e.g., rotate or translate) in the wellbore. For example, the computing device can transmit a signal associated with two well tools contacting one another to the electronic device. The electronic device can cause the well tool (e.g., farther into the wellbore) to stop moving in response to the signal.

In some examples, the computing device can determine that two well tools coupled together based on multiple pressure differences determined by the computing device over a period of time. For example, the computing device can analyze the multiple pressure differences to determine if the multiple pressure differences indicate a trend or pattern associated with two well tools coupling together. Data associated with the pattern or trend can be stored in memory (e.g., memory 408 of FIG. 3) or calculated using an algorithm stored in memory.

In block 712, the computing device can determine that two well tools did not contact one another, did not couple together, or both. The computing device can output a notification indicating that the two well tools did not contact one another, did not couple together, or both.

Figure 8:
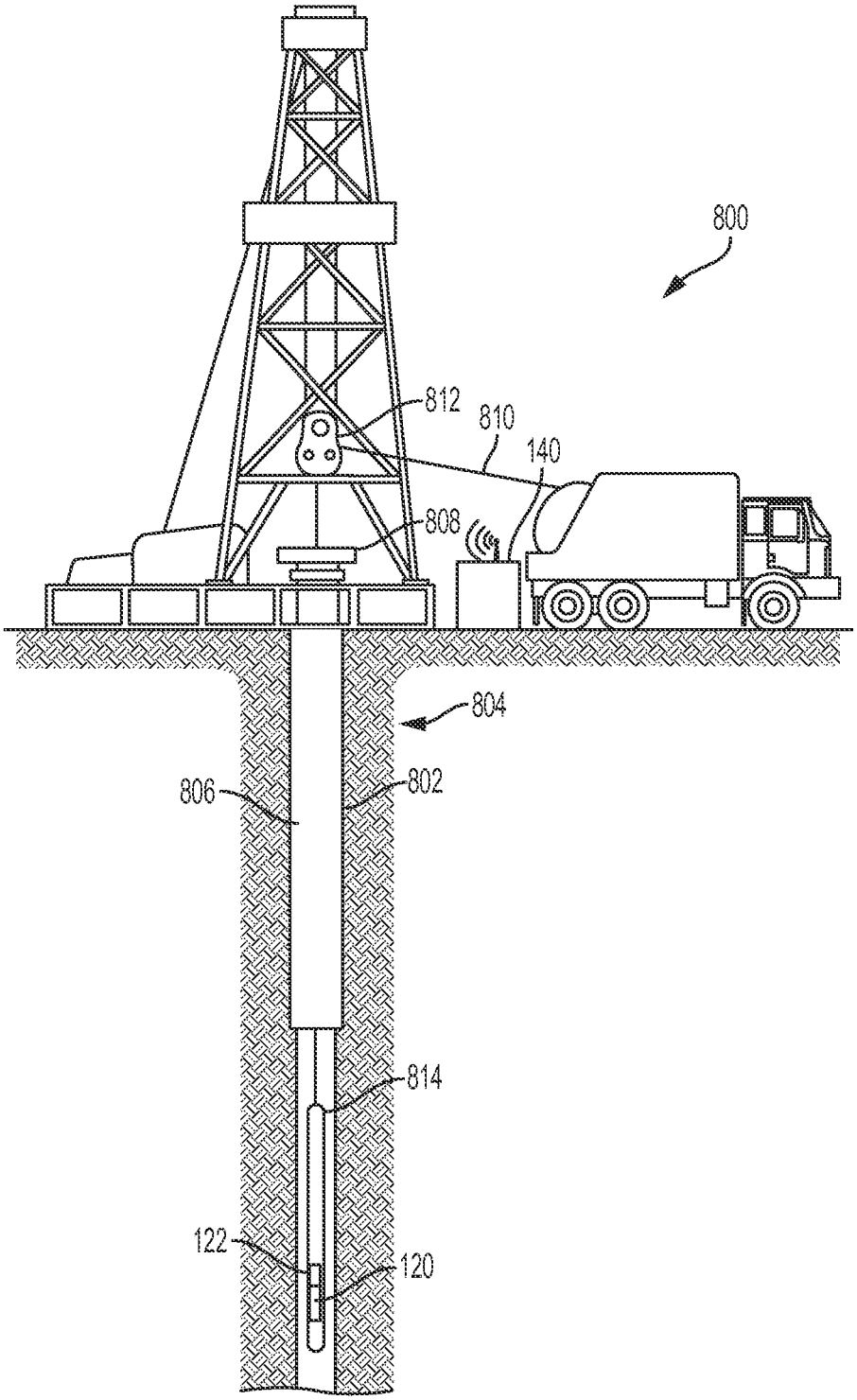
FIG. 8 is a cross-sectional view of an example of a hydrocarbon extraction well system that includes a subsystem for determining downhole forces using pressure differentials according to some aspects.

FIG. 8 is a cross-sectional view of an example of a hydrocarbon extraction well system 800 that includes a subsystem for determining downhole forces using pressure differentials according to some aspects. The hydrocarbon extraction well system 800 includes a wellbore 802 extending through various earth strata. The wellbore 802 extends through a hydrocarbon bearing subterranean formation 804. A casing string 806 extends from the well surface 808 to the subterranean formation 804. The casing string 806 can provide a conduit through which formation fluids, such as production fluids produced from the subterranean formation 804, can travel from the wellbore 802 to the well surface 808. The casing string 806 can be coupled to the walls of the wellbore 802 via cement. For example, a cement sheath can be positioned or formed between the casing string 806 and the walls of the wellbore 802 for coupling the casing string 806 to the wellbore 802.

The hydrocarbon extraction well system 800 can include at least one well tool 814 (e.g., a formation-testing tool). The well tool 814 can be coupled to a wireline 810, slickline, or coiled tube that can be deployed into the wellbore 802. The wireline 810, slickline, or coiled tube can be guided into the wellbore 802 using, for example, a guide 812 or winch. In some examples, the wireline 810, slickline, or coiled tube can be wound around a reel.

In some examples, the well tool 814 can include a pressure-sensing device 120 for determining downhole forces using pressure differentials. The pressure-sensing device 120 can include one or more pressure sensors coupled to the well tool 814 for detecting one or more pressures. The pressure-sensing device 120 can detect one or more pressures and transmit sensor signals associated with the one or more pressures via a communication device 122 to a computing device 140. In some examples, the computing device 140 can receive the sensor signals and determine, based on the sensor signals, whether the well tool 814 has contacted another well component (e.g., another well tool, the casing string 806, or a wall of the wellbore 802), with how much force the well tool 814 contacted another well component, or both.

Figure 9:
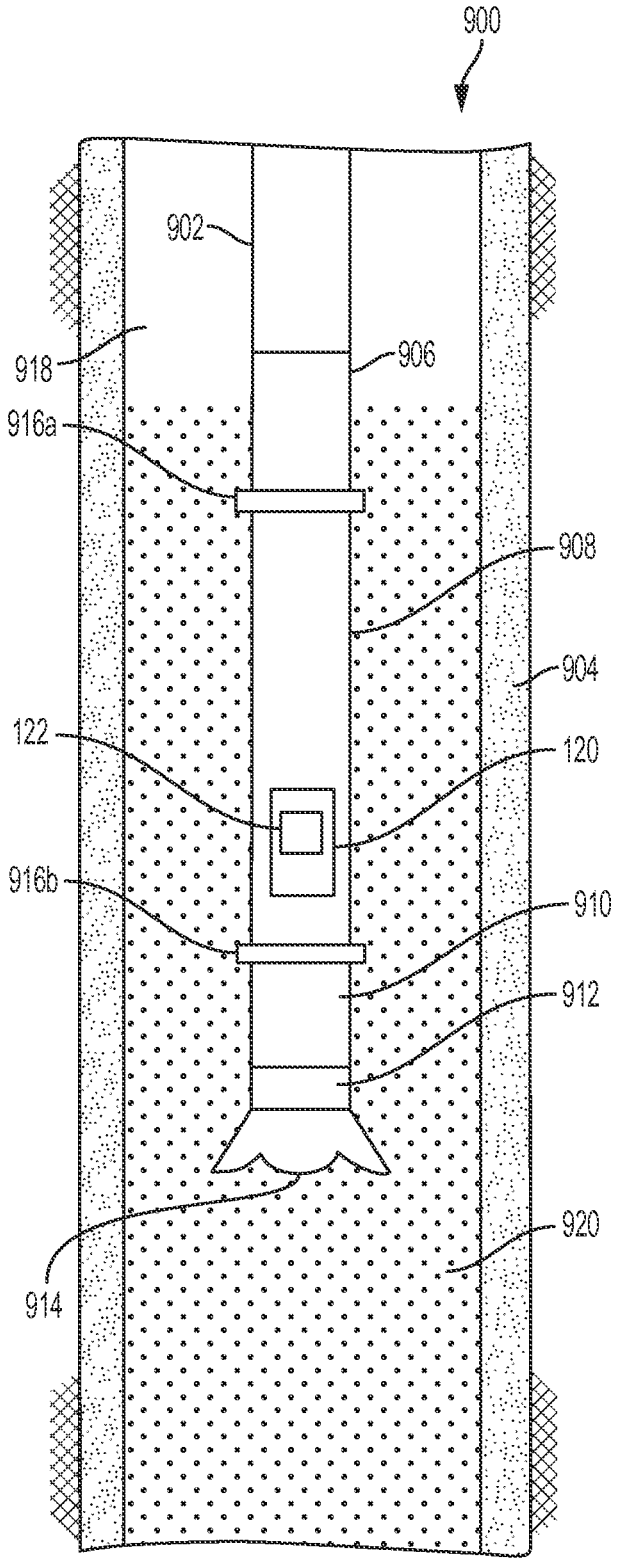
FIG. 9 is a cross-sectional view of an example of a part of a hydrocarbon extraction well system that includes a subsystem for determining downhole forces using pressure differentials according to some aspects.

FIG. 9 is a cross-sectional view of an example of a part of a hydrocarbon extraction well system 900 that includes a subsystem for determining downhole forces using pressure differentials according to some aspects. The well system 900 includes a wellbore. The wellbore can include a casing string, a cement sheath 904, or both. In some examples, the wellbore can include a fluid 920 (e.g., mud). The fluid 920 can flow in an annulus 918 positioned between the well tool 902 and a well component (e.g., cement sheath 904).

A well tool 902 (e.g., logging-while-drilling tool) can be positioned in the wellbore. The well tool 902 can include various subsystems 906, 908, 910, 912. For example, the well tool 902 can include a subsystem 906 that includes a communication subsystem, a saver subsystem, or a rotary steerable system. A tubular section or an intermediate subsystem 908 (e.g., a mud motor or measuring-while-drilling module) can be positioned between the other subsystems 906, 910. In some examples, the well tool 902 can include a drill bit 914 for drilling the wellbore. The drill bit 914 can be coupled to another tubular section or intermediate subsystem 908 (e.g., a measuring-while-drilling module or a rotary steerable system). In some examples, the well tool 902 can also include tubular joints 916*a*, 916*b*.

In some examples, the well tool 902 can include a pressure-sensing device 120 for determining downhole forces using pressure differentials. The pressure-sensing device 120 can include one or more pressure sensors coupled to the well tool 902 for detecting one or more pressures. The pressure-sensing device 120 can detect one or more pressures and transmit sensor signals associated with the one or more pressures via a communication device 122 to a computing device. In some examples, the computing device can receive the sensor signals and determine, based on the sensor signals, whether the well tool 902 has contacted another well component (e.g., another well tool, the cement sheath 904, a bottom of a wellbore, or a wall of a wellbore), with how much force the well tool 902 contacted another well component, or both.

In some aspects, systems and methods for determining downhole forces using pressure differentials are provided according to one or more of the following examples:

Example #1

A system for use in a wellbore can include an upper completion string. The upper completion string can include an outer mandrel and an inner mandrel positioned coaxially within the outer mandrel. The upper completion string can include a first pressure sensor in communication with a first chamber via a first channel extending through an outer housing of the outer mandrel for detecting a first pressure within the first chamber and transmitting a first sensor signal associated with the first pressure. The first chamber can have a first boundary that is defined at least in part by (i) an outer surface of the inner mandrel, (ii) an inner surface of the outer mandrel, and (iii) at least two protrusions positioned between the outer surface of the inner mandrel and the inner surface of the outer mandrel. The system can include a computing device in communication with the first pressure sensor for receiving the first sensor signal and determining a pressure difference between the first pressure and a reference pressure.

Example #2

The system of Example #1 may feature a second pressure sensor in communication with a second chamber via a second channel extending through the outer housing of the outer mandrel for detecting a second pressure within the second chamber and transmitting a second sensor signal associated with the second pressure. The second chamber can have a second boundary that is defined at least in part by (i) the outer surface of the inner mandrel, (ii) the inner surface of the outer mandrel, and (iii) the at least two protrusions positioned between the outer surface of the inner mandrel and the inner surface of the outer mandrel. The at least two protrusions can define a common boundary between the first chamber and the second chamber. The computing device can be in communication with the second pressure sensor for receiving the second sensor signal and the reference pressure comprises the second pressure.

Example #3

The system of Example #2 may feature a fluid positioned within the first chamber and the second chamber. The computing device can include a processing device and a memory device in which instructions executable by the processing device are stored. The instructions can be for causing the processing device to: receive the first sensor signal and the second sensor signal; determine the first pressure based on the first sensor signal and the second pressure based on the second sensor signal; determine the pressure difference by comparing the first pressure to the second pressure; and/or determine that the upper completion string contacted a lower completion string in response to the pressure difference exceeding a threshold.

Example #4

The system of Example #3 may feature the memory device including instructions executable by the processing device for causing the processing device to: determine that an amount of force with which the upper completion string contacted the lower completion string includes the pressure difference.

Example #5

The system of any of Examples #2-4 may feature at least two of: a first sealing device, a second sealing device, and a third sealing device. The first sealing device can be positioned coaxially around the outer surface of the inner mandrel and adjacent to a longitudinal end of the first chamber for generating a pressure seal between the first chamber and an external well environment. The second sealing device can be positioned coaxially around the outer surface of the inner mandrel and between the at least two protrusions. The second sealing device can be for generating another pressure seal between the first chamber and the second chamber. The third sealing device can be positioned coaxially around the outer surface of the inner mandrel and adjacent to another longitudinal end of the second chamber for generating the pressure seal between the second chamber and the external well environment.

Example #6

The system of Example #1 may feature a second pressure sensor positioned in the wellbore separate from the upper completion string for detecting the reference pressure and transmitting the reference pressure to the computing device.

Example #7

The system of Example #6 may feature the computing device including a processing device and a memory device in which instructions executable by the processing device are stored. The instructions can be for causing the processing device to: receive the first pressure from the first pressure sensor; receive the reference pressure from the second pressure sensor; determine a calibration value based on (i) a weight of a fluid positioned between the first pressure sensor and the second pressure sensor and (ii) a distance between the first pressure sensor and the second pressure sensor; determine a calibrated pressure by adding the calibration value to the reference pressure; and/or determine the pressure difference by subtracting the first pressure from the calibrated pressure.

Example #8

An upper completion string can include an outer mandrel and an inner mandrel positioned coaxially within the outer mandrel. The upper completion string can include a first pressure sensor in communication with a first chamber via a first channel extending through an outer housing of the outer mandrel for detecting a first pressure within the first chamber and transmitting a first sensor signal associated with the first pressure. The first chamber can include a first boundary that is defined at least in part by (i) an outer surface of the inner mandrel, (ii) an inner surface of the outer mandrel, and (iii) at least two protrusions positioned between the outer surface of the inner mandrel and the inner surface of the outer mandrel.

Example #9

The upper completion string of Example #8 may feature a second pressure sensor in communication with a second chamber via a second channel extending through the outer housing of the outer mandrel for detecting a second pressure within the second chamber and transmitting a second sensor signal associated with the second pressure. The second chamber can include a second boundary that is defined at least in part by (i) the outer surface of the inner mandrel, (ii) the inner surface of the outer mandrel, and (iii) the at least two protrusions positioned between the outer surface of the inner mandrel and the inner surface of the outer mandrel. The at least two protrusions can define a common boundary between the first chamber and the second chamber.

Example #10

The upper completion string of Example #9 may feature the first pressure sensor and the second pressure sensor being in communication with a computing device for determining a pressure difference between the first pressure and the second pressure.

Example #11

The upper completion string of Example #10 may feature the computing device including a processing device and a memory device in which instructions executable by the processing device are stored. The instructions can be for causing the processing device to: receive the first sensor signal and the second sensor signal; determine the first pressure based on the first sensor signal and the second pressure based on the second sensor signal; determine the pressure difference by comparing the first pressure to the second pressure; determine that the upper completion string contacted a lower completion string in response to the pressure difference exceeding a threshold; and/or determine that an amount of force with which the upper completion string contacted the lower completion string includes the pressure difference.

Example #12

The upper completion string of any of Examples #9-11 may feature at least two of: a first sealing device, a second sealing device, and a third sealing device. The first sealing device can be positioned coaxially around the outer surface of the inner mandrel and adjacent to a longitudinal end of the first chamber for generating a pressure seal between the first chamber and an external well environment. The second sealing device can be positioned coaxially around the outer surface of the inner mandrel and between the at least two protrusions. The second sealing device can be for generating another pressure seal between the first chamber and the second chamber. The third sealing device can be positioned coaxially around the outer surface of the inner mandrel and adjacent to another longitudinal end of the second chamber for generating the pressure seal between the second chamber and the external well environment.

Example #13

The upper completion string of Example #8 may feature the upper completion string being positionable in a wellbore that includes a second pressure sensor. The second pressure sensor can be separate from the upper completion string for detecting a second pressure and transmitting the second pressure to a computing device.

Example #14

The upper completion string of Example #13 may feature the computing device including a processing device and a memory device in which instructions executable by the processing device are stored. The instructions can be for causing the processing device to: receive the first pressure from the first pressure sensor; receive the second pressure from the second pressure sensor; determine a calibration value based on (i) a weight of a fluid positioned between the first pressure sensor and the second pressure sensor and (ii) a distance between the first pressure sensor and the second pressure sensor; determine a calibrated pressure by adding the calibration value to the second pressure; and/or determine a pressure difference by subtracting the first pressure from the calibrated pressure.

Example #15

A pressure-sensing device for use in a wellbore can include a first pressure sensor in communication with a first chamber via a first channel extending through an outer housing of an outer mandrel of a well tool for detecting a first pressure within the first chamber and transmitting a first sensor signal associated with the first pressure. The first chamber can include a first boundary that is defined at least in part by (i) an outer surface of an inner mandrel positioned coaxially within the outer mandrel, (ii) an inner surface of the outer mandrel, and (iii) at least two protrusions positioned between the outer surface of the inner mandrel and the inner surface of the outer mandrel. The pressure-sensing device can include a second pressure sensor in communication with a second chamber via a second channel extending through the outer housing of the outer mandrel for detecting a second pressure within the second chamber and transmitting a second sensor signal associated with the second pressure. The second chamber can include a second boundary that is defined at least in part by (i) the outer surface of the inner mandrel, (ii) the inner surface of the outer mandrel, and (iii) the at least two protrusions positioned between the outer surface of the inner mandrel and the inner surface of the outer mandrel. The at least two protrusions can define a common boundary between the first chamber and the second chamber.

Example #16

The pressure-sensing device of Example #15 may feature a computing device in communication with the first pressure sensor and the second pressure sensor. The computing device can include a processing device and a memory device in which instructions executable by the processing device are stored. The instructions can be for causing the processing device to: receive the first sensor signal and the second sensor signal; determine the first pressure based on the first sensor signal and the second pressure based on the second sensor signal; determine a pressure difference by comparing the first pressure to the second pressure; and/or determine that the well tool contacted a well component in response to the pressure difference exceeding a threshold.

Example #17

The pressure-sensing device of Example #16 may feature the memory device including instructions executable by the processing device for causing the processing device to: determine that an amount of force with which the well tool contacted the well component includes the pressure difference.

Example #18

The pressure-sensing device of any of Examples #15-17 may feature at least two of: a first sealing device, a second sealing device, and a third sealing device. The first sealing device can be positioned coaxially around the outer surface of the inner mandrel and adjacent to a longitudinal end of the first chamber for generating a pressure seal between the first chamber and an external well environment. The second sealing device can be positioned coaxially around the outer surface of the inner mandrel and between the at least two protrusions. The second sealing device can be for generating another pressure seal between the first chamber and the second chamber. The third sealing device can be positioned coaxially around the outer surface of the inner mandrel and adjacent to another longitudinal end of the second chamber for generating the pressure seal between the second chamber and the external well environment.

Example #19

The pressure-sensing device of Example #15 may feature the pressure-sensing device including a computing device in communication with the first pressure sensor and a third pressure sensor positioned in the wellbore for detecting a third pressure and transmitting the third pressure to the computing device.

Example #20

The pressure-sensing device of Example #19 may feature the computing device including a processing device and a memory device in which instructions executable by the processing device are stored. The instructions can be for causing the processing device to: receive the first pressure from the first pressure sensor; receive the third pressure from the third pressure sensor; determine a calibration value based on (i) a weight of a fluid positioned between the first pressure sensor and the third pressure sensor, and (ii) a distance between the first pressure sensor and the third pressure sensor; determine a calibrated pressure by adding the calibration value to the third pressure; and/or determine a pressure difference by subtracting the first pressure from the calibrated pressure.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system for use with a wellbore, the system comprising:

a well tool that is positionable in the wellbore and includes:

an outer mandrel;

an inner mandrel positioned coaxially within the outer mandrel;

a first chamber having a first boundary that is defined at least in part by (i) an outer surface of the inner mandrel, (ii) an inner surface of the outer mandrel, and (iii) at least two protrusions positioned between the outer surface of the inner mandrel and the inner surface of the outer mandrel;

a first pressure sensor in communication with the first chamber of the well tool for detecting a first pressure within the first chamber and transmitting a first sensor signal associated with the first pressure; and a computing device comprising a processing device and a memory device, the memory device including instructions that are executable by the processing device for causing the processing device to:

receive the first sensor signal from the first pressure sensor and a second sensor signal from a second pressure sensor;

determine the first pressure based on the first sensor signal and a second pressure based on the second sensor signal;

determine a pressure difference based on the first pressure and the second pressure; and determine that the well tool contacted a well component in response to the pressure difference exceeding a threshold.

2. The system of claim 1, wherein the well tool further comprises:

a second chamber having a second boundary that is defined at least in part by (i) the outer surface of the inner mandrel, (ii) the inner surface of the outer mandrel, and (iii) the at least two protrusions positioned between the outer surface of the inner mandrel and the inner surface of the outer mandrel, the at least two protrusions defining a common boundary between the first chamber and the second chamber; and the second pressure sensor in communication with the second chamber for detecting the second pressure within the second chamber and transmitting the second sensor signal associated with the second pressure.

3. The system of claim 2, further comprising at least two of:

a first sealing device positioned coaxially around the outer surface of the inner mandrel and adjacent to a longitudinal end of the first chamber for generating a pressure seal between the first chamber and an external well environment;

a second sealing device positioned coaxially around the outer surface of the inner mandrel and between the at least two protrusions, the second sealing device for generating another pressure seal between the first chamber and the second chamber; or a third sealing device positioned coaxially around the outer surface of the inner mandrel and adjacent to another longitudinal end of the second chamber for generating the pressure seal between the second chamber and the external well environment.

4. The system of claim 1, wherein the memory device further includes instructions executable by the processing device for causing the processing device to:

determine an amount of force with which the well tool contacted the well component based on the pressure difference.

5. The system of claim 1, wherein the second pressure sensor is positioned in the wellbore separate from the well tool for detecting the second pressure and transmitting the second pressure to the computing device.

6. The system of claim 5, wherein the memory device further includes instructions that are executable by the processing device for causing the processing device to:

determine a calibration value based on (i) a weight of a fluid positioned between the first pressure sensor and the second pressure sensor and (ii) a distance between the first pressure sensor and the second pressure sensor;

determine a calibrated pressure by adding the calibration value to the second pressure; and determine the pressure difference by subtracting the first pressure from the calibrated pressure.

7. The system of claim 1, wherein the well tool includes an upper completion string.

8. The system of claim 7, wherein the well component includes a lower completion string.

9. A system comprising:

a well tool comprising:

an outer mandrel;

an inner mandrel positioned coaxially within the outer mandrel;

a first chamber having a first boundary that is defined at least in part by (i) an outer surface of the inner mandrel, (ii) an inner surface of the outer mandrel, and (iii) at least two protrusions positioned between the outer surface of the inner mandrel and the inner surface of the outer mandrel; and a first pressure sensor in communication with the first chamber for detecting a first pressure within the first chamber and transmitting a first sensor signal associated with the first pressure;

a second pressure sensor for detecting a second pressure and transmitting a second sensor signal associated with the second pressure; and a computing device comprising a processing device and a memory device, the memory device including instructions that are executable by the processing device for causing the processing device to:

receive the first sensor signal from the first pressure sensor and the second sensor signal from the second pressure sensor;

determine the first pressure based on the first sensor signal and the second pressure based on the second sensor signal;

determine a calibration value based on (i) a weight of a fluid positioned between the first pressure sensor and the second pressure sensor and (ii) a distance between the first pressure sensor and the second pressure sensor;

determine a calibrated pressure by adding the calibration value to the second pressure; and determine a pressure difference by subtracting the first pressure from the calibrated pressure.

10. The system of claim 9, wherein the memory device further comprises instructions that are executable by the processing device for causing the processing device to:

determine that the well tool contacted a well component in response to the pressure difference exceeding a threshold; and determine an amount of force with which the well tool contacted the well component based on the pressure difference.

11. The system of claim 9, wherein the well tool includes at least two of:

a first sealing device positioned coaxially around the outer surface of the inner mandrel and adjacent to a longitudinal end of the first chamber for generating a pressure seal between the first chamber and an external well environment;

a second sealing device positioned coaxially around the outer surface of the inner mandrel and between the at least two protrusions, the second sealing device for generating another pressure seal between the first chamber and a second chamber; or a third sealing device positioned coaxially around the outer surface of the inner mandrel and adjacent to another longitudinal end of the second chamber for generating the pressure seal between the second chamber and the external well environment.

12. The system of claim 9, wherein the well tool includes an upper completion string.

13. The system of claim 9, wherein the second pressure includes a pressure of an external well environment outside the well tool.

14. The system of claim 9, wherein the second pressure sensor is separate from the well tool.

15. A system comprising:

a pressure-sensing device for use in a wellbore, the pressure-sensing device comprising:

a first chamber having a first boundary that is defined at least in part by (i) an outer surface of an inner mandrel that is positioned coaxially within an outer mandrel of a well tool, (ii) an inner surface of the outer mandrel, and (iii) at least two protrusions positioned between the outer surface of the inner mandrel and the inner surface of the outer mandrel; and a first pressure sensor in communication with the first chamber for detecting a first pressure within the first chamber and transmitting a first sensor signal associated with the first pressure;

a second pressure sensor for detecting a second pressure of an external well environment that is external to the well tool and transmitting a second sensor signal associated with the second pressure; and a computing device comprising a processing device and a memory device, the memory device including instructions that are executable by the processing device for causing the processing device to:

receive the first sensor signal from the first pressure sensor and the second sensor signal from the second pressure sensor;

determine the first pressure based on the first sensor signal and the second pressure based on the second sensor signal;

determine a pressure difference based on the first pressure and the second pressure; and determine that the well tool contacted a well component in response to the pressure difference exceeding a threshold.

16. The system of claim 15, wherein the memory device further includes instructions executable by the processing device for causing the processing device to:

determine that an amount of force with which the well tool contacted the well component includes the pressure difference.

17. The system of claim 15, further comprising at least two of:

a first sealing device positioned coaxially around the outer surface of the inner mandrel and adjacent to a longitudinal end of the first chamber for generating a pressure seal between the first chamber and the external well environment;

a second sealing device positioned coaxially around the outer surface of the inner mandrel and between the at least two protrusions, the second sealing device for generating another pressure seal between the first chamber and a second chamber; or a third sealing device positioned coaxially around the outer surface of the inner mandrel and adjacent to another longitudinal end of the second chamber for generating the pressure seal between the second chamber and the external well environment.

18. The system of claim 15, wherein the second pressure sensor is coupled to the well tool.

19. The system of claim 15, wherein the well tool includes an upper completion string.

20. The system of claim 15, wherein the second pressure sensor is separate from the well tool.

* * * * *